US006289623B1

(12) United States Patent
Cohen et al.

(10) Patent No.: US 6,289,623 B1
(45) Date of Patent: Sep. 18, 2001

(54) DEVICE FOR REDUCING THE DANGER OF HARM CAUSED BY ACCIDENTAL DISCHARGE OF A BULLET FROM A FIREARM

(75) Inventors: Michael Cohen; Yehoshua Altman, both of Kibbutz Kfar Etzion (IL)

(73) Assignee: Mofet Etzion Agricultural Association Ltd., Mobile Post North Yehuda (IL)

( * ) Notice: Subject to any disclaimer, the term of this patent is extended or adjusted under 35 U.S.C. 154(b) by 0 days.

(21) Appl. No.: 09/337,698

(22) Filed: Jun. 21, 1999

(51) Int. Cl.[7] ..... F41A 21/26; F41A 21/32; F41A 35/04

(52) U.S. Cl. ..... 42/96; 89/14.5; 102/485

(58) Field of Search ..... 42/105, 96; 89/14.5; 102/485

(56) References Cited

U.S. PATENT DOCUMENTS

| | | | | |
|---|---|---|---|---|
| 3,243,909 | | 4/1966 | Kotikov . | |
| 3,664,263 | | 5/1972 | Driscoll . | |
| 3,690,026 | | 9/1972 | Rose . | |
| 3,934,513 | | 1/1976 | Gabriëls . | |
| 4,448,129 | | 5/1984 | Gabriëls . | |
| 5,349,906 | * | 9/1994 | Devaux et al. | 102/485 |
| 5,377,438 | * | 1/1995 | Sheinfeld et al. | 42/96 |
| 5,574,245 | * | 11/1996 | Buc et al. | 102/485 |
| 6,176,032 | * | 1/2001 | Cohen et al. | 42/96 |

FOREIGN PATENT DOCUMENTS

| | | | | |
|---|---|---|---|---|
| 2223833 | * | 4/1990 | (GB) | 102/485 |
| 591485 | * | 4/1959 | (IT) | 42/105 |

* cited by examiner

*Primary Examiner*—Charles T. Jordan
*Assistant Examiner*—Kyongtaek K. Mun
(74) *Attorney, Agent, or Firm*—Townsend and Townsend and Crew LLP

(57) ABSTRACT

The invention provides a device for reducing the danger of harm caused by the accidental discharge of a bullet from a firearm, including an attachment for engaging the muzzle end of a firearm barrel; a substantially tubular body having a cavity and coaxially attachable at one of its ends to the barrel via the attachment; an impact disc having upper and lower surfaces, slidably disposed in the cavity of the tubular body; an energy-absorbing and storing element interposed in the tubular body between the upper surface of the impact disc and an abutting member, the absorbing and storing element acting on the impact disc to maintain contact with the abutting member inside the body, and a body made of a material at least as hard as the material of the bullets to be used with the fiream, the body being affixed at the lower surface of the impact disc, for substantially preventing a bullet from piercing through the impact disc; whereby, upon the discharge of a bullet, the bullet impacts the body, transferring some of its kinetic energy to the energy-absorbing element and thereby reducing the danger of harm caused by the accidental discharge of the bullet from the firearm.

18 Claims, 1 Drawing Sheet

DEVICE FOR REDUCING THE DANGER OF HARM CAUSED BY ACCIDENTAL DISCHARGE OF A BULLET FROM A FIREARM

FIELD OF THE INVENTION

The present invention relates to a device for reducing the danger of harm caused by the accidental discharge of a bullet from a firearm. In particular, the present invention is especially useful for reducing the danger of harm caused by the accidental discharge of an armour-piercing bullet from a firearm.

BACKGROUND OF THE INVENTION

The problem of firearm-caused accidents due to the accidental discharge of bullets is a serious one, and has found no real solution beyond exhortatory and disciplinary efforts, the effects of which are unfortunately rather limited. The basic cause of these accidents is obviously the "cartridge in the chamber," which devolves the entire responsibility for safety upon the safety catch, which cannot always be relied upon under field conditions.

DISCLOSURE OF THE INVENTION

It is therefore an object of the present invention to provide a device attachable to various types of firearms, such as single-shot, semi-automatic and automatic weapons, which will reduce the danger of harm caused by the discharge of a bullet from a firearm.

It is a further object of the present invention to provide such a device which is especially suitable for use with armour-piercing cartridges.

It is a still further object of the present invention to provide a device capable of reducing the danger of harm caused by discharge of an armour-piercing bullet from a firearm, however, allowing the continuation of firing of armour-piercing bullets without interruption.

A still further object of the invention is to provide a device for reducing the danger of harm caused by the accidental discharge of a-bullet-from a firearm, incorporating an indicator for specifying that the device has already fulfilled its function and should be replaced by a new one.

According to the present invention, there is therefore provided a device for reducing the danger of harm caused by the accidental discharge of a bullet from a firearm, comprising attachment means adapted to engage the muzzle end of a firearm barrel; a substantially tubular body having a cavity and coaxially attachable at one of its ends to said barrel via said attachment means; an impact disc having upper and lower surfaces, slidably disposed in the cavity of said tubular body; an energy-absorbing and storing means interposed in said tubular body between the upper surface of said impact disc and an abutting means, said absorbing and storing means acting on said impact disc to maintain contact with said abutting means inside said body, and a body made of a material at least as hard as the material of the bullets to be used with the firearm, said body being affixed at the lower surface of said impact disc, for substantially preventing a bullet from piercing through said impact disc; whereby, upon the discharge of a bullet, said bullet impacts said body, transferring some of its kinetic energy to said energy-absorbing means and thereby reducing the danger of harm caused by the accidental discharge of said bullet from said firearm.

BRIEF DESCRIPTION OF THE DRAWINGS

The invention will now be described in connection with certain preferred embodiments with reference to the following illustrative figures so that it may be more fully understood.

With specific reference now to the figures in detail, it is stressed that the particulars shown are by way of example and for purposes, of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 1 is a cross-sectional view of the device according to the invention for reducing the danger of harm caused by the accidental discharge of a bullet from a firearm, said device being shown attached to a rifle barrel;

FIG. 2 is a cross-sectional view of a preferred embodiment of the device of FIG. 1; and FIG. 3 is a side view of an embodiment of an indicator incorporated in the device of FIG. 1.

DETAILED DESCRIPTION

Figure 1:
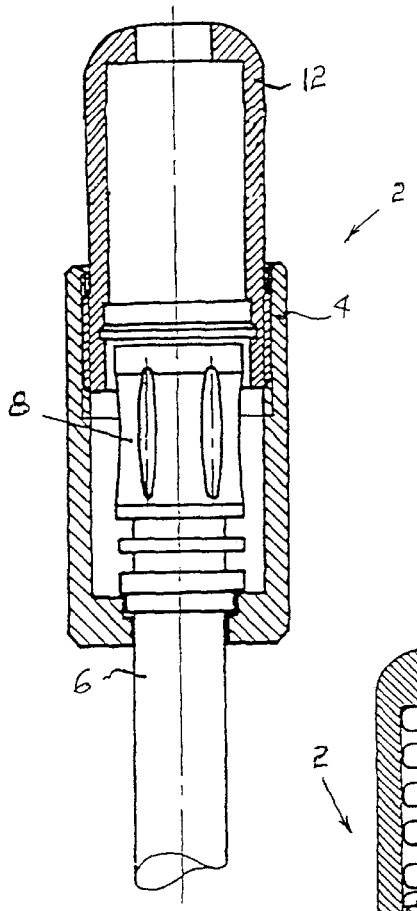

Referring now to the drawings, there is shown a preferred embodiment of a device 2 for reducing the danger of harm caused by the accidental discharge of a bullet from a firearm, including a sleeve 4 for attaching the device to the muzzle end of a firearm barrel 6 by means of a screwed-on standard flash suppressor 8. Sleeve 4 is provided with an internal thread 10 for engagement with a tubular body 12 having an eternal thread 14 on one of its end portions 16. A peripheral groove 18 is formed inside body 12 for retaining the outer periphery of a springy ring 20, said ring forming an abutment shoulder for adjustment washer 22. Device 2 further includes an impact disc 24 made of a material softer than the material of the bullets used in said firearm, e.g., of steel, formed with a shoulder 26 abutting the disc 24 by means of an helical compression spring 28 bearing, at one end thereof, against the upper surface 30 of the impact disc 24, and at the other end, against the inside top surface 32 of tubular body 12.

Instead of the sleeve 4 for attaching the device to a firearm, there may be provided a tubular or ring-like member having an external thread adapted to engage the threaded lower inside portion of tubular body 12 and an internal thread for engaging a treaded barrel of a firearm, for example, a pistol.

In the surface 34, opposite surfaces 30, there is embedded in the disc 24 a body 36 made of a material harder than the material of the bullet to be used with the firearm such as ceramic, steel, carbide and the like, capable of withstanding the impact of an armour-piercing bullet. The body 36 can be configured as a ball, as a cylinder having one or two curved bases, or merely as a disc. The configuration of the body is determined by consideration of the material of the bullet which it is meant to withstand, the force or impact of the bullet, etc., and the body can be attached to the impact disc in any desired manner.

There is optionally provided an indicator 38, concentrically disposed within spring 28 and advantageously embodied by a spring having an inside diameter which is larger than the outer diameter of the bullets to be fired. The outer diameter of the indicator is slightly less than the inner diameter of helical compression spring 28, facilitating contact between the indicator and said spring. As further seen in FIG. 2, indicator 38 is provided with a base portion 40 disposed between the disc surface 30 and spring 28, and is sized of a length which normally terminates short of the upper end 42 of tubular body 12. Indicator 38 may just as well be embodied by a rigid, tubular member; however, a flexible member, such as a spring, has the advantage of withstanding impacts without breaking.

In use, when the device 2 is attached to a firearm as shown in FIG. 1 and even an armour-piercing bullet is accidentally discharged, the bullet will hit the impact body 36 while moving impact disc 24 against the force of compression spring 28, thus absorbing the impact. The body 36 will either be shattered into small or larger pieces, or it will hardly be harmed, depending, inter alia, on the type of bullet used.

The gases discharged by the shot will re-cock the firearm, facilitating the next shot. Hence, in a case where the body 36 was shattered, if the next shot is fired, the armour-piercing bullet will pierce impact disc 24, thus enabling the continuation of firing.

The impact of a bullet on body 36 will cause a contraction movement of spring 28 towards surface 32, dragging the indicator 38 in the same direction and effecting the protrusion of free end portion 44 beyond surface 42. Due to the sudden and violent force acting on compression spring 28, it loses its recoil capability and remains in its contracted state, thus not dragging the indicator back into its retracted position. Thus, the extended indicator 38 provides both a visual and tactile warning to the user that the device has already been used and must be replaced to provide protection against the accidental firing of a bullet.

Figure 2:
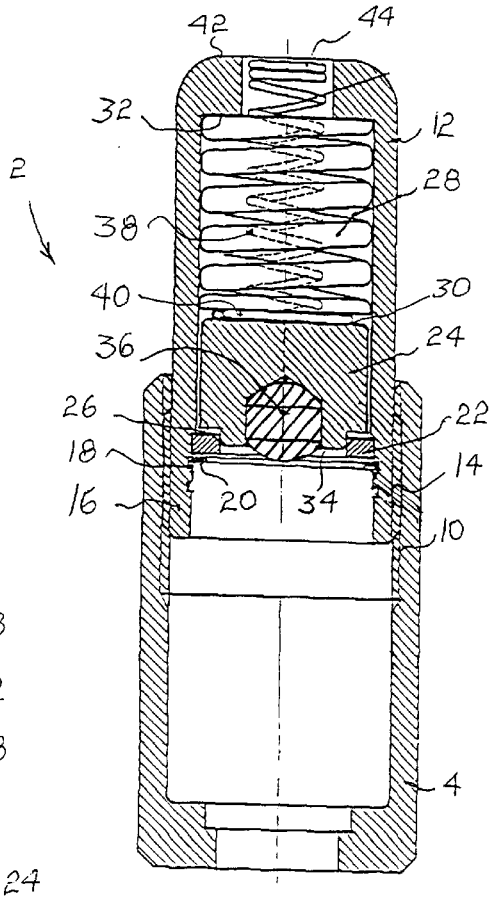
Figure 3:
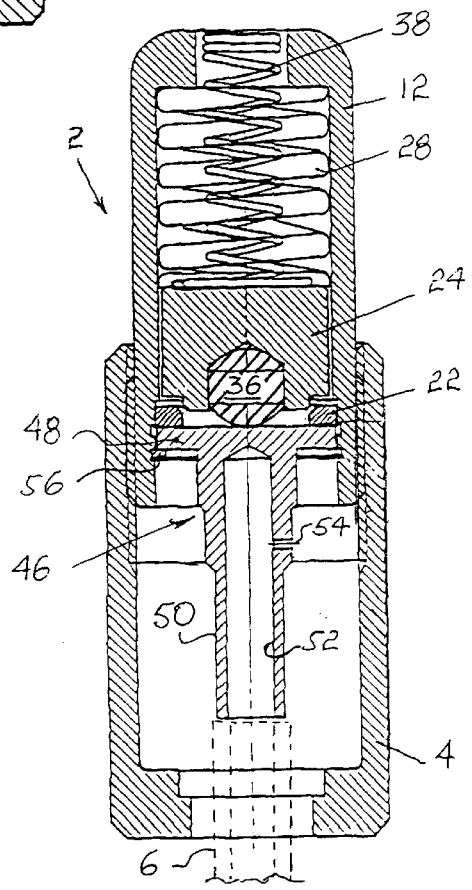

The same device 2 shown in FIG. 2 may be adapted for use also to reduce the danger of harm caused by the accidental discharge of a bullet from blank or drill cartridges. For this purpose, device 2 is fitted with an insert 46, as shown in FIG. 3. The insert 46 is T-shaped in general, having a portion 48 extending across the tubular body 4, and a leg portion 50 having a bore 52 of a diameter greater than the size of the barrel's bore. A through-going hole 54 is made in leg portion 50, for allowing the controlled release of gases, soot and gunpowder. Insert 46 is introduced into body 12 between ring 20 and adjustment washer 22. For this purpose, a second, peripheral groove 56 may be formed in the inside surface of body 12, so as to enable the affixing of insert 46 inside device 2 when it is required to be used with blank cartridges.

The operation of the device of FIG. 3 is similar to the operation of the device of FIG. 2, as follows: as long as blank cartridges are fired, the firearm is re-cocked by the gases entering bore 52, which are only slowly discharged through hole 54. When a bullet is accidentally fired, however, it will pierce through the material of portion 48 of insert 46 and impact body 36, thereby reducing the danger of harm caused by its being discharged from the firearm.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all chances which come within the meaning and range of equivalency of the claims are therefore intended to be embraced therein.

What is claimed is:

1. A device for reducing the danger of harm caused by the accidental discharge of a bullet from a firearm, comprising:

attachment means adapted to engage the muzzle end of a firearm barrel;

a substantially tubular body having a cavity and coaxially attachable at one of its ends to said barrel via said attachment means;

an impact disc having upper and lower surfaces, slidably disposed in the cavity of said tubular body;

spring means interposed in said tubular body between the inside top surface of said tubular body and the upper surface of said impact disc, the lower surface of said impact disc retained by an abutment in said tubular body, said spring means acting on said impact disc to maintain contact with said impact disc with said abutment inside said tubular body, and a body made of a material at least as hard as the material of the bullets to be used with the firearm, said body being affixed at the lower surface of said impact disc, for substantially preventing a bullet from piercing through said impact disc;

whereby, upon the discharge of a bullet, said bullet impacts said body, transferring some of its kinetic energy to said spring means and thereby reducing the danger of harm caused by the accidental discharge of said bullet from said firearm.

2. The device as claimed in claim 1, wherein said body is cylindrical and has at least one curved base.

3. The device as claimed in claim 1, wherein said body is a ceramic body.

4. The device as claimed in claim 1, wherein firearm barrel has a particular caliber, and said spring means is a first helical compression spring freely fitting in said cavity in said tubular body, said spring means having an internal diameter larger than the caliber of said firearm.

5. The device as claimed in claim 1, further comprising an adjustment washer interposed between said impact disc, said insert and a shouldered inside surface of said tubular body.

6. The device as claimed in claim 1, wherein said attachment means is configured to be engaged and held in position by a firearm's flash suppressor.

7. The device as claimed in claim 1, wherein said attachment means and said tubular body are detachably connected to each other by means of threads.

8. The device as claimed in claim 1, wherein said body is at least partly embedded in said impact disc.

9. The device as claimed in claim 8, wherein a portion of said body protrudes from the lower surface of said impact disc.

10. The device as claimed in claim 1, further comprising indicating means having a base and a free end, said free end being arranged to protrude through said tubular body upon the accidental firing of a bullet, so as to constitute an indication of said firing and the need to replace the device with another one.

11. The device as claimed in claim 10, wherein said base abuts the impact disc and said free end terminates within said tubular body.

12. The device as claimed in claim 10, wherein said indicating means is tubular.

13. The device as claimed in claim 12, wherein said indicating means is a second helical spring, freely fitting the cavity in said first helical spring.

14. The device as claimed in claim 1, further comprising a bullet-pierceable insert having a portion traversing the axis of said barrel and a tubular portion.

15. The device as claimed in claim 14, wherein said insert is T-shaped, having a tubular leg portion defining a cavity, extending from said portion traversing the axis of said barrel and sized so that the free end thereof contacts the muzzle end of said firearm barrel.

16. The device as claimed in claim 14, further comprising a springy ring seated in a peripheral groove in the inside surface of the lower end of said tubular body, said ring forming an abutment shoulder for holding said insert.

17. The device as claimed in claim 15, wherein the cavity of said tubular leg portion has a diameter greater than the diameter of the barrel of the firearm with which the device is to be used.

18. The device as claimed in claim 15, wherein sad leg portion is provided with a hole to allow the escape therethrough of gases, soot and gunpowder.

* * * * *